US011267605B2

(12) United States Patent
Solomon et al.

(10) Patent No.: US 11,267,605 B2
(45) Date of Patent: Mar. 8, 2022

(54) CONDIMENT CONTAINER

(71) Applicants: Thomas Solomon, Red Rock, TX (US); Kyle Kruger, Cypress, TX (US)

(72) Inventors: Thomas Solomon, Red Rock, TX (US); Kyle Kruger, Cypress, TX (US)

( * ) Notice: Subject to any disclaimer, the term of this patent is extended or adjusted under 35 U.S.C. 154(b) by 79 days.

(21) Appl. No.: 16/375,590

(22) Filed: Apr. 4, 2019

(65) Prior Publication Data

US 2019/0308765 A1 Oct. 10, 2019

Related U.S. Application Data

(60) Provisional application No. 62/652,854, filed on Apr. 4, 2018.

(51) Int. Cl.
*B65D 85/72* (2006.01)
*B65D 1/34* (2006.01)

(52) U.S. Cl.
CPC ..... *B65D 1/34* (2013.01); *B65D 85/72* (2013.01)

(58) Field of Classification Search
CPC ..... B65D 1/34; B65D 85/75; B65D 81/3244; B65D 81/3255; A47G 19/03; A47G 21/001; A23P 20/17
USPC ..... 426/115; 220/574
See application file for complete search history.

(56) References Cited

U.S. PATENT DOCUMENTS

D75,735 S 4/1928 Kintz
D75,939 S 7/1928 Tennhardt
3,407,969 A 10/1968 Klein
D222,680 S 11/1971 Douglas
3,620,403 A 11/1971 Rump
D249,218 S 9/1978 Mathison
D249,491 S 9/1978 Bernhardt
5,397,036 A 3/1995 Maiwald
5,676,990 A * 10/1997 Wawrzynski ..... B65D 77/30 118/100
D419,364 S 1/2000 Jarvis
6,230,969 B1 * 5/2001 Spransy ..... B65D 81/3205 220/23.4
6,263,732 B1 7/2001 Hoeting
D504,799 S 5/2005 Lawson
D620,809 S 8/2010 Caldwell
D625,961 S 10/2010 Kent
D657,628 S 4/2012 Sink
8,342,359 B2 * 1/2013 Cannon, III ..... B65D 1/40 220/780
D678,632 S 3/2013 Chance
D701,088 S 3/2014 Hone
D706,995 S 6/2014 Modi
(Continued)

OTHER PUBLICATIONS www.wingdipper.com, date unknown, author unknown.
(Continued)

*Primary Examiner* — King M Chu

(57) ABSTRACT

A condiment container comprises a body having a side wall, a bottom, and an open top, the side wall and the bottom defining a reservoir that can contain a condiment. The side wall includes a steep portion and a ramp portion, the ramp portion having an angle relative to the bottom that is greater than the angle of the steep portion relative to the bottom. A food item, such as a chicken wing, can be inserted into reservoir and applied with condiment, and the food item can be dragged across the ramp portion to distribute the condiment in a desirable manner.

18 Claims, 6 Drawing Sheets

(56) References Cited

U.S. PATENT DOCUMENTS

| | | | | |
|---|---|---|---|---|
| 8,844,757 | B2 * | 9/2014 | Wilmers | B65D 75/326 220/608 |
| D781,109 | S | 3/2017 | Rubino | |
| D782,754 | S | 3/2017 | Veness | |
| 10,053,272 | B2 | 8/2018 | Doherty | |
| D839,053 | S | 1/2019 | Huang | |
| D841,402 | S | 2/2019 | Price | |
| D858,213 | S | 9/2019 | Wu | |
| D867,071 | S | 11/2019 | Berger | |
| 10,472,128 | B2 | 11/2019 | Ciarrocchi | |
| 2009/0301923 | A1 * | 12/2009 | Van Puijenbroek | B65D 1/22 206/518 |
| 2011/0284119 | A1 | 11/2011 | Andrews | |
| 2013/0206767 | A1 | 8/2013 | Cannon, III | |
| 2016/0221742 | A1 * | 8/2016 | Edwards | B65B 29/08 |
| 2018/0008067 | A1 * | 1/2018 | Jones | B65D 47/263 |

OTHER PUBLICATIONS http://crioma.com/image/cache/catalog/Sauce%20containers/Sauce%20container%20with%20lid%2060%20cc-500x500.jpg, date unknown, author unknown.

http://padco.com/default9463.html?PID=1.1.23, date unknown, author unknown.

https://www.statelinetack.com/item/little-giant-better-bucket/E002950/, date unknown, author unknown.

Copending design U.S. Appl. No. 29/643,147 and all associated files, including the Office Action dated Jan. 2, 2020.

* cited by examiner

CONDIMENT CONTAINER

PRIORITY

The present application claims the benefit of domestic priority based on U.S. Provisional Patent Application 62/652,854 filed on Apr. 4, 2018, the entirety of which is incorporated herein by reference.

BACKGROUND

Many foods are simply not complete without being slathered with a condiment. Whether it is a meat such as a chicken wing or chicken strip, a vegetable such as a fried potato or crudité, or a chip such as a fried tortilla or potato, there is something supremely satisfying about the additional flavor and soothing effect of an accompanying condiment.

Of particular current interest is the chicken wing industry. The advent of chicken wings served with buffalo, barbeque, jerk, or other spicy sauce has led to an ever-increasing need for dipping sauces, such as ranch or blue cheese sauce, that complement the spices to create an enticing and balanced experience. However, these dipping sauces are traditionally served in a circular cup that is not specifically designed to accommodate the food item that is being dipped. As a result, the application of condiment onto a food item such as a chicken wing is often an unsatisfying and tedious experience. Usually the non-meaty end of the wing must be inserted first leading to an over-accumulation of condiment on a part of the wing that does not have a corresponding amount of meat. When a bite is then taken, a user will either get a predominance of condiment without much meat or will get a large portion of meat without sufficient amounts of condiment. Larger containers that allow a wing to be inserted more lengthwise require large amounts of condiment to fill. These containers lead to a high degree of wasted condiment and are thus not cost-effective.

The food industry has not heretofore offered a condiment container that is specifically designed to advantageously facilitate the application of a condiment onto a particular food item, such as a chicken wing.

Thus, there is therefore a need for an improved condiment container that allows for better and/or more convenient application of a condiment to various shaped and sized food items. There is further a need for a condiment container that can better distribute condiment to an elongated food item that needs condiment more along its central region than at its ends. There is still a further need to accomplish improved condiment application with a desirably small volume of condiment.

SUMMARY

The present invention satisfies these needs. In one aspect of the invention, an improved condiment container is provided.

In another aspect of the invention, a condiment container is specifically sized and shaped to distribute condiment to an elongated food item.

In another aspect of the invention, a condiment container is specifically sized and shaped to distribute condiment to an elongated food item that needs condiment on its central region.

In another aspect of the invention, a condiment container is specifically sized and shaped to distribute condiment to a chicken wing.

In another aspect of the invention, a condiment container is provided that reduced the amount of condiment necessary to adequately distribute condiment to a food item.

In another aspect of the invention, a condiment container is provided with a ramp portion at one or more ends thereof.

In another aspect of the invention, a process for applying condiment to a food item provides condiment to the food item in an improved manner.

In another aspect of the invention a condiment container comprises a body having a side wall, a bottom, and an open top, the side wall and the bottom define a reservoir that can contain a condiment, wherein the side wall includes a steep portion and a ramp portion, the ramp portion having an angle relative to the bottom that is greater than the angle of the steep portion relative to the bottom, whereby a food item can be inserted into reservoir and applied with condiment and whereby the food item can be dragged across the ramp portion to distribute the condiment in a desirable manner.

In another aspect of the invention, a condiment container comprises a body having a side wall, a bottom, and an open top, the side wall and the bottom defining a reservoir that can contain a condiment, wherein the open top is defined by an upper edge of the side wall and wherein the open top has an elongated shape defined by the side wall having longitudinally extending side portions that converge so that a rear portion of the side wall is wider than a front portion of the side wall, and wherein the angle of the rear portion of the side wall relative to the bottom is greater than the angle of the longitudinally extending side portions relative to the bottom, whereby a food item can be inserted into reservoir and applied with condiment and whereby the food item can be dragged across the rear portion to distribute the condiment in a desirable manner.

In another aspect of the invention, a method of applying condiment to a food item comprises providing a condiment container comprising a body having a side wall, a bottom, and an open top, the side wall and the bottom defining a reservoir that can contain a condiment, wherein the side wall includes a ramp portion having a slope that is less steep than another portion of the side wall; inserting a food item into condiment in the reservoir; and dragging the food item across the ramp portion to distribute the condiment in a desirable manner.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a container. In particular, the invention relates to a container for holding a condiment. Although the condiment container is illustrated and described in the context of being useful for holding and distributing a condiment onto a food item such as a chicken wing, the present invention can be useful in other instances. Accordingly, the present invention is not intended to be limited to the examples and embodiments described herein.

Figure 1A:
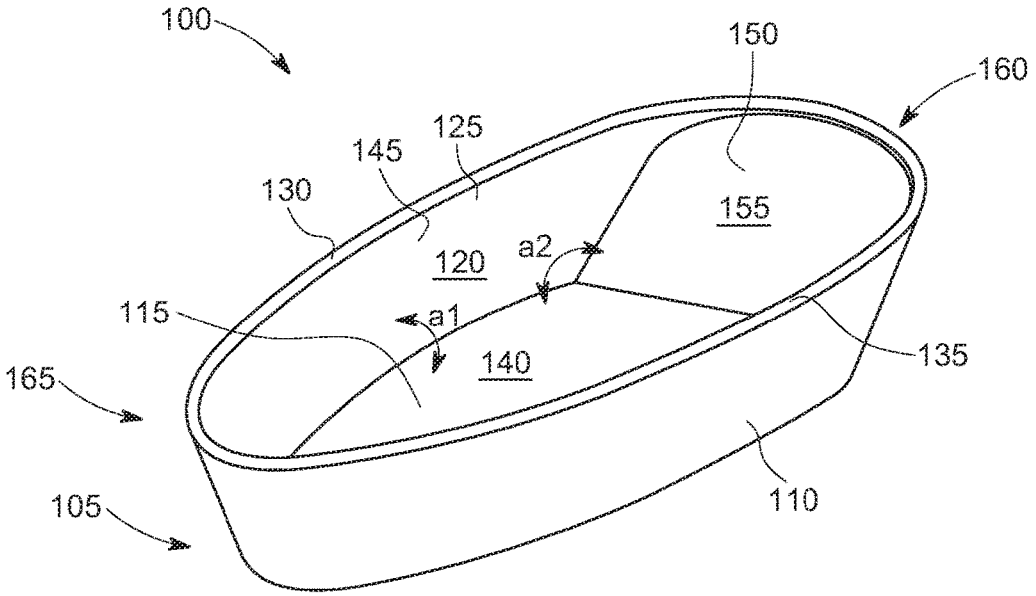
FIG. 1A is a schematic perspective view of a condiment container according to one version of the invention.

FIG. 1A shows a condiment container 100 according to one version of the invention. The condiment container 100 is made up of a body 105 have a side wall 110 and a bottom 115. The side wall 110 and the bottom 115 define a reservoir 120 that can contain a condiment. At the top of the condiment container 100 is an opening 125 that forms an open top that provides access to the reservoir 120. Thus, when the reservoir 120 contains a condiment, a user may dip a food item into the condiment by inserting the food item through the opening 125 and into the condiment in the reservoir 120. The opening 125 is defined by the upper edge 130 of the side wall 110. The upper 130 may optionally include a lip 135 that extends inwardly from the side wall 110 and partially into the opening 125 and/or outwardly from the side wall 110 and away from the opening 125. The bottom 115 includes an at least partially flat or planar portion 140. The flat or planar portion 140 allows the condiment container 100 to rest on a flat surface, such as a table, tray, or bar, without undue wobbling. The flat or planar portion 140 may include one or more raised portions that extend inwardly into the container. The raised portions allow for markings, such as branding, to be included on the raised portion. By being raised from the planar section, the markings do not interfere with the stability of the container when it sits on a flat surface. The bottom 115 extends from an interior surface 145 of the side wall 115. The interior surface 145 and the bottom 115 form a concave cavity that creates the reservoir 120.

As can be seen in the version of FIG. 1A, the side wall 110 includes a ramp portion 150. The ramp portion 150 extends along a section of the side wall 115 but not its entirety. The ramp portion 150 has a different shape, a different curvature, and/or a different angle of steepness than at least a portion of the section of the side wall 115 that is not part of the ramp portion 150. In the specific version shown in FIG. 1A, the ramp portion 150 includes an at least partially flat or planar inner surface 155. The ramp portion 150 facilitates an improved condiment coating process when distributing condiment on the food item. When the ramp portion 150 is provided on a rear end or portion 160 of the body 105, after a food item has been inserted into the condiment in the reservoir 120, the food item may be dragged or pulled rearwardly and across the ramp portion 150 to distribute condiment in a desirable manner. The ramp portion 150, by being sloped less than the steep portion of the side wall 110, allows for improved condiment coverage independent of the amount of condiment in the reservoir 120. By dipping the food item toward the forward end or portion 165 of the container 100 and then dragging the food item towards the rear end 160, the condiment accumulates under the food item and the ramp portion 150 helps to spread the condiment over the food item. In this way, the ramp portion 150 serves to more evenly distribute the condiment around the food item rather than having the food item be too heavily coated on the bottom and less coated on one or more of the other sides. In addition, the ramp portion 150 can help a user regulate the amount of condiment on their food item. By lightly tapping and/or dragging the food item across the ramp portion 150, a more controllable amount of condiment can be removed from the food item. The inner surface 155 of the ramp portion 150 can be provided with projections, such as ridges or bumps, if desired. The ramp portion 150 is also particularly useful when being used to apply condiment to a chicken wing because it helps distribute condiment to the center of the wing where the meat is located rather than to the ends where there is less or no meat. Whereas in a conventional condiment container, most of the condiment is frustratingly applied to the meatless ends of the wing.

The condiment container 100 works well with any condiment. The condiment container 100 is ideally suited for use with condiments that are thick, viscous, and/or sticky. Examples of thick, viscous, and/or sticky condiments includes ranch dressing or sauce, blue cheese dressing or sauce, buffalo sauce, ketchup, barbeque sauce, mustard sauce, honey mustard sauce, salsa, cheese and/or queso sauce or dip, onion dip, French onion dip, dill dip, other cream-based or sour-cream-based dips, spinach dip, artichoke dip, chutneys, tartar sauce, and the like. The condiment container 100 also works well with less thick and less viscous condiments, such as soy sauce and vinegar. With the less thick and less viscous condiments, a user can allow the food item to rest on the ramp portion 150 for a period of time to allow a desirable amount of the condiment to run off the food item. Examples of food items that may be dipped into the condiment in the condiment container 100 include chicken wings, chicken fingers, chicken nuggets, other pieces of meat including fried meat, fish sticks, French fries, potato wedges, vegetables, fried vegetables, potato chips, tortilla chips, cheese sticks, pizza slices, taquitos, calamari, and the like.

Figure 1B:
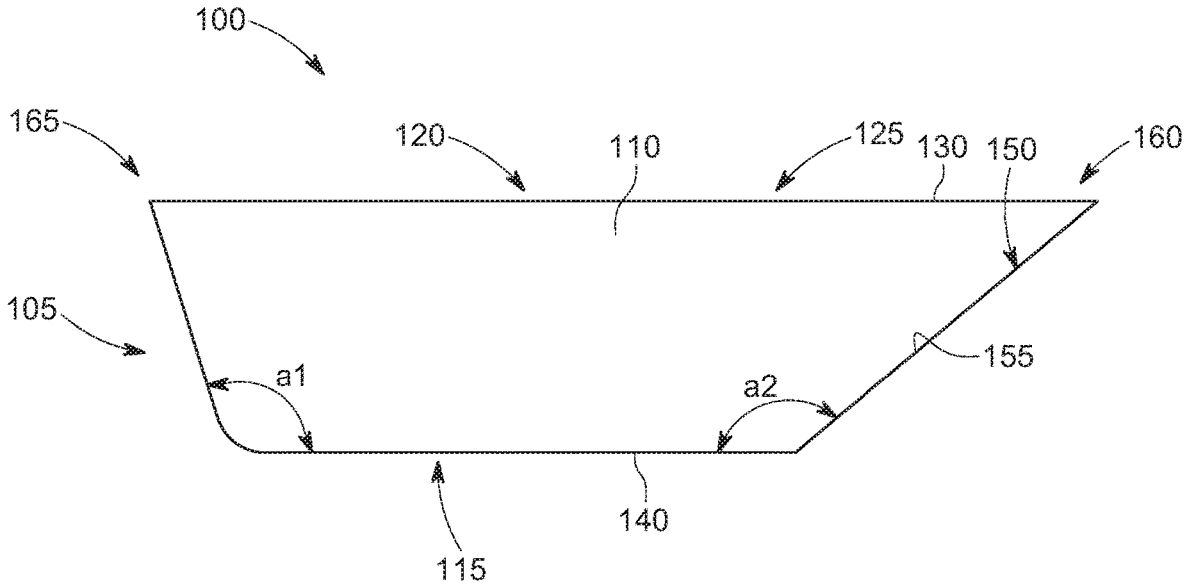
FIG. 1B is a schematic side view of the condiment container of FIG. 1A.

The side wall 110 comprises the ramp portion 150 and at least one steep portion that is not the ramp portion 150. As can be seen in FIG. 1A and in the side view of FIG. 1B, the ramp portion 150 has an angle, a2, relative to the bottom 115 and/or the planar portion 140 of the bottom 115 and/or a horizontal surface that the condiment container 100 is placed on that is greater than an angle, a1, between at least one other portion or steep portion of the side wall 110 and the bottom 115 and/or the planar portion 140 of the bottom 115 and/or the horizontal surface. Since a2 is greater than a1, the ramp portion 150 portion is created which constitutes a less steep section of the side wall 110. Preferably both a1 and a2 are 90 degrees or more so as to reduce the amount of condiment necessary to fill the reservoir 120. In one version, a2 is 10 degrees or more greater than a1, more preferably 20 degrees or more greater than a1, more preferably 30 degrees or more greater than a1, and most preferably about 40 degrees greater than a1. Though not shown, in another version, multiple ramps can be provided on the condiment container 100. For example, in one particular version, a ramp portion 150 can be provided on the rear end 160 and on the front end 165 of the condiment container 100. In this version, each ramp portion 150 would have an angle a2, though they may each be the same or different, and both of the a2 would be greater than an angle, a1, of a different portion of the side wall 110, such as the left or right side of the side wall 110. When a ramp and/or a side wall is not planar or substantially planar, the ramp portion 150 will have more than 50% of its surface at an angle, a2, that is greater than the angle, a1, of more than 50% of the surface of another portion of the side wall. More preferably the angle a2 will be greater than a1 by at least the above listed ranges.

Figure 2A:
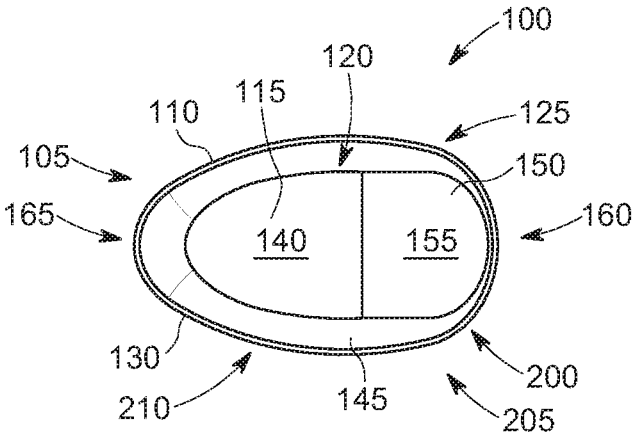
FIG. 2A is a schematic top view of a version of a condiment container according to the invention.
Figure 2B:
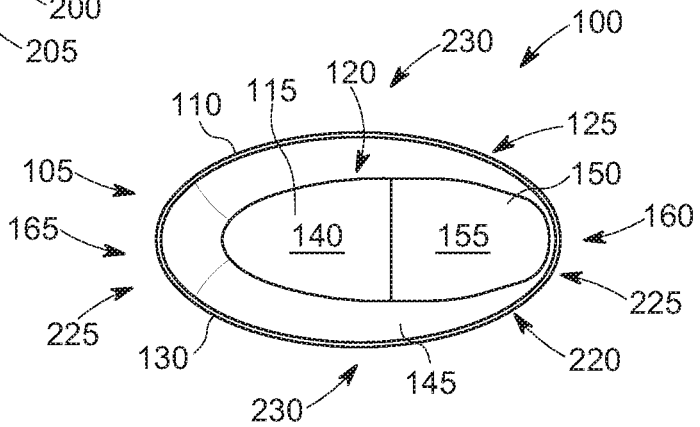
FIG. 2B is a schematic top view of another version of a condiment container according to the invention.
Figure 2C:
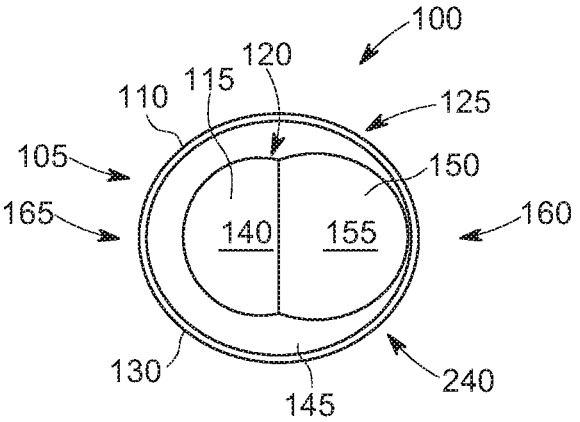
FIG. 2C is a schematic top view of another version of a condiment container according to the invention.
Figure 2D:
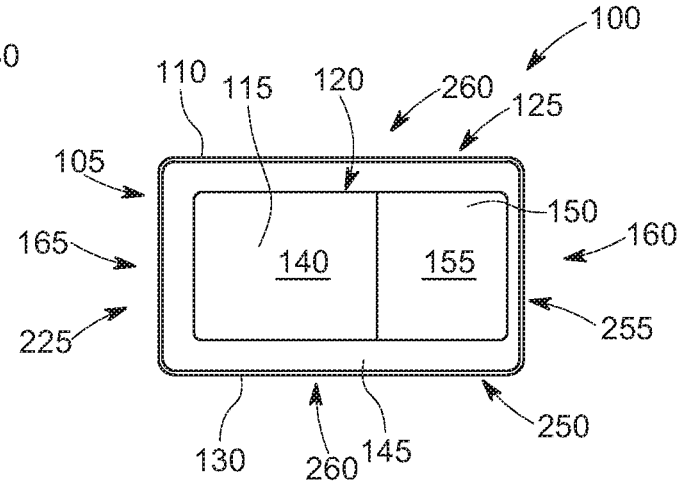
FIG. 2D is a schematic top view of another version of a condiment container according to the invention.

The shape of the upper edge 130 and/or the opening 125 may be one of any of numerous shapes, as shown in FIGS. 2A through 2D. The shape of the edges can be round or straight or a combination thereof. For example, In FIG. 2A, the upper edge 130 is shaped to define an elongate opening 125. The elongate opening 125 can be oval or rectangular or the like. In one version, such as the one shown, the side wall can include longitudinally extending side portions that converge so that the rear portion 160 is wider than the front portion 165. For example, the elongated opening 125 can have a generally triangular, trapezoidal, or ovate shape. By ovate it is meant egg-shaped or a section of an ovoid. The ovate opening 200 has a wide end 205 that is wider than its opposite narrow end 210. In the version of FIG. 2A, the wide end 205 is provided on the rear 160 and contains the ramp portion 150. FIG. 2B shows a condiment container 100 with an oval opening 220. The oval opening 220 has two opposing narrow ends 225 and two opposing wider sides 230. In the version of FIG. 2B, the ramp portion 150 is provided at one or both of the narrow ends 225. However, the ramp portion 150 could alternatively or additionally be provided on one or both of the wider sides 230. In the version of FIG. 3C, the opening 125 and the upper edge 130 are circular. The circular opening 240 opens to allow access to the ramp portion 150 at its rear end 160. In the version of FIG. 2D, the opening 125 comprises a square or rectangular opening 250. The condiment container 100 of FIG. 2D has straight opposing sides 255 at its rear end 160 and forward end 165 and straight opposing sides 260 on both sides. The opposing sides 260 may be shorter than, the same as, or greater than the length of the rear and forward opposing sides 255. Other versions may be polygonal, such as trapezoidal or other polygonal shape or may be a combination of any of the above.

In one version, the opening 125 is sized and shaped so that it best accommodates a particular food item. For example, the condiment container 100 of FIG. 2A with an ovate opening 200 is particularly well suited for dipping chicken wings into a condiment, such as ranch or blue cheese sauce or any other chicken wing sauce. By providing the ramp portion 150 on the rear end 160 and with the wide end 205 the shape is advantageous for improved gripping and dipping of the wing. The wide end 205 allows for different sizes and shapes of chicken wings and many other types of food items. The more elongated versions, such as the ones shown in FIGS. 2B and 2D are particularly suited for French fries and other elongated food items, such as fish sticks. The circular opening 240 version of FIG. 2C is ideal for round or circular food items, such as onion rings, calamari, or the like.

Figure 3A:
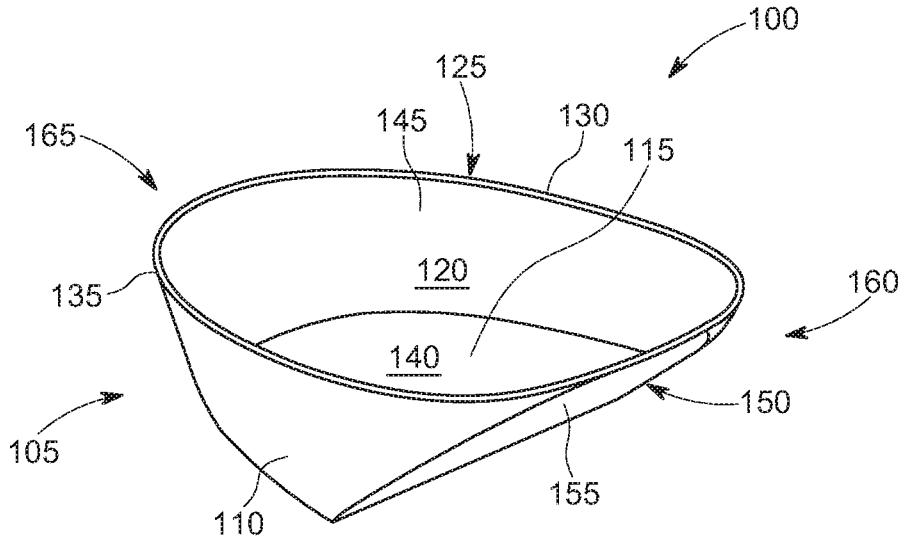
FIG. 3A is a schematic perspective side view of a condiment container according to one version of the invention.
Figure 3B:
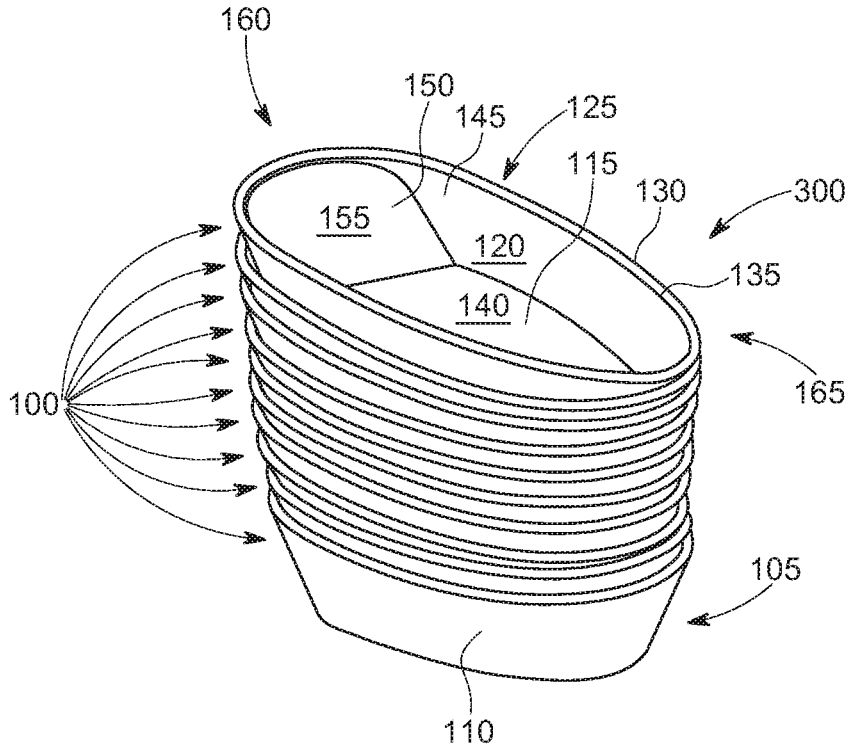
FIG. 3B is a schematic perspective side view of a plurality of the condiment containers of FIG. 3A stacked on top of one another.

FIG. 3A shows another view of the version of FIG. 1A condiment container from a perspective towards the read end 160. As can be seen in this version, the side wall 110 is made up of a wall that forms an angle greater than 90 degrees with the bottom 115. In this manner, the top of the condiment container 100 is wider and longer than the bottom. Accordingly, one condiment container is able to nest within another. In this way, multiple condiment containers 100 are able to be stacked 300, as shown in FIG. 3B.

Figure 4A:
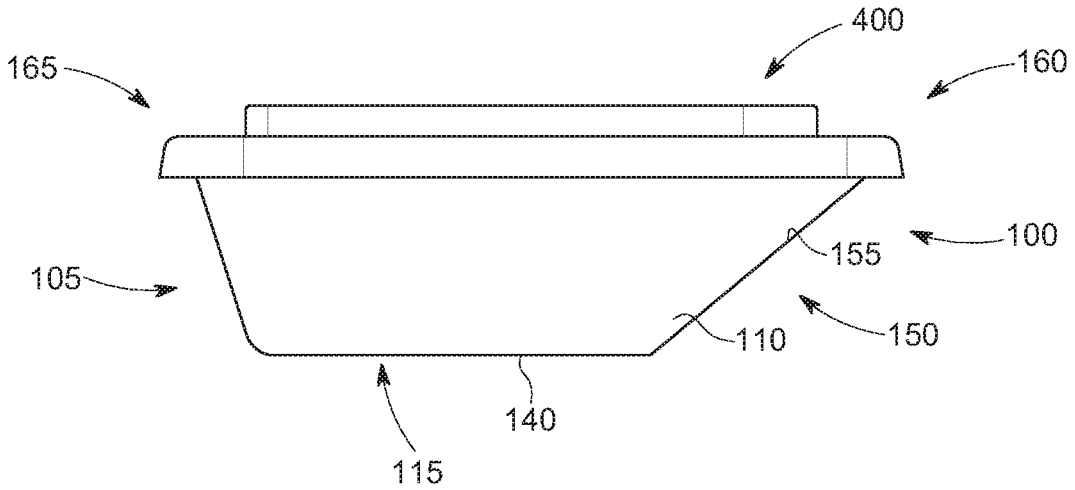
FIG. 4A is a schematic side view of a condiment container of the invention with a lid.
Figure 4B:
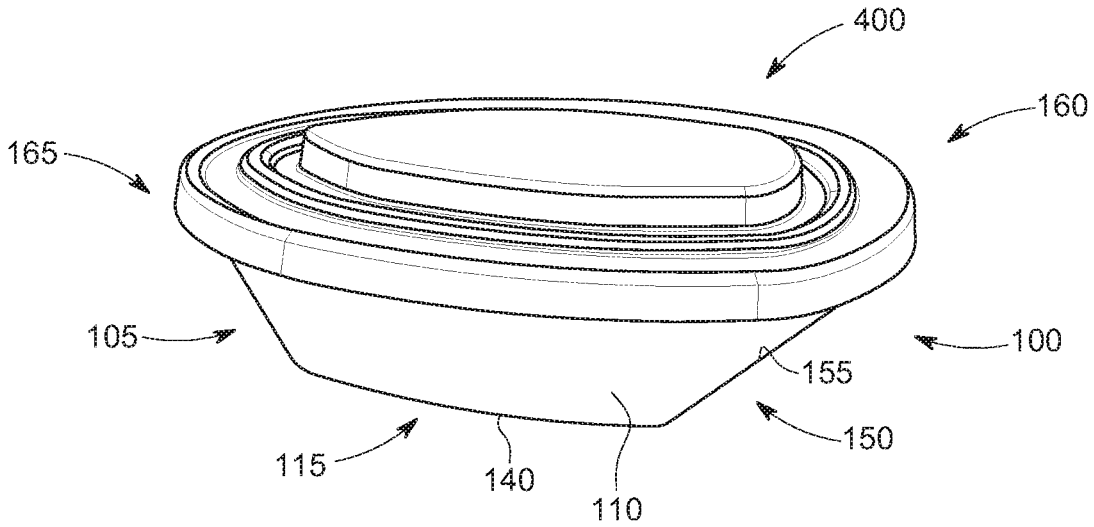
FIG. 4B is a schematic perspective view of the condiment container and lid of FIG. 4A.

FIGS. 4A and 4B show, respectively, a side view and a perspective view of a version of a condiment container 100 that includes a lid 400. The lid 400 may include a mechanism that releasably attaches to the lip 135 on the body 105 of the condiment container 100. The lid 400 may be pressed on and pulled off of the lip 135 so that condiment within the reservoir 120 of the condiment container 100 can be transported and/or stored. The shape of the lid 400 corresponds to the shape of the opening 125 of the condiment container 100. In one version, the lids 400 are individually stackable. In another version, the lid 400 can be flatter to aid in stackability and to reduce the amount of plastic or other material that is used. Logos or other markings can be included on the lid as well.

Figure 5A:
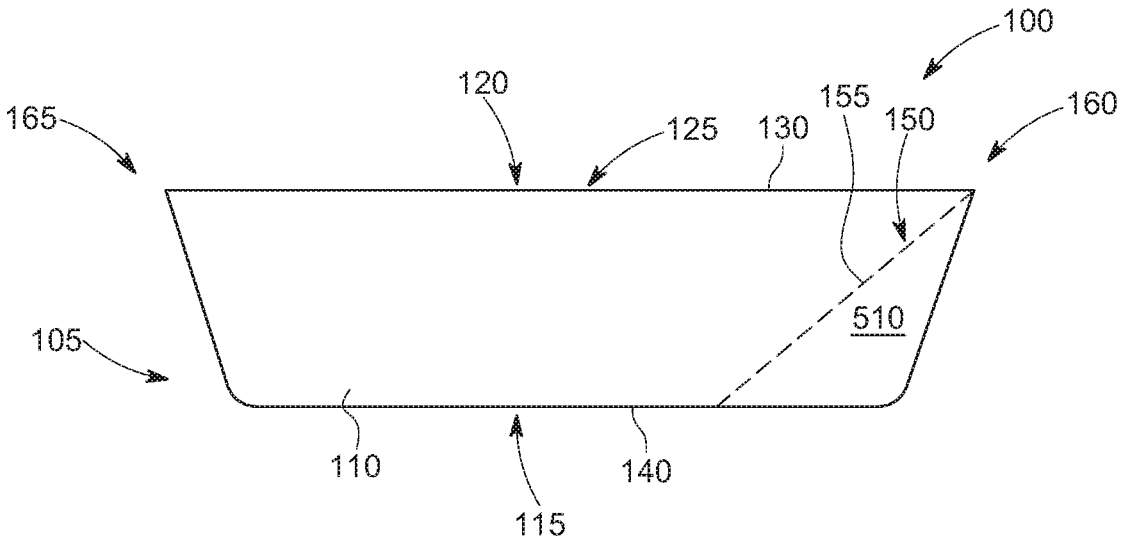
FIG. 5A is a schematic side view of another version of a condiment container according to the invention.
Figure 5B:
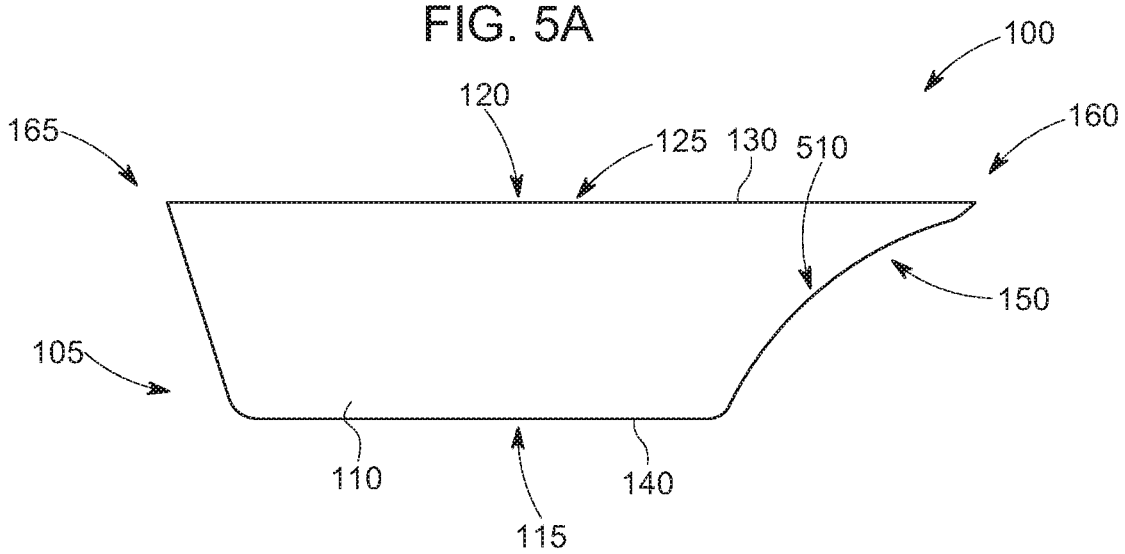
FIG. 5B is a schematic side view of another version of a condiment container according to the invention.
Figure 5C:
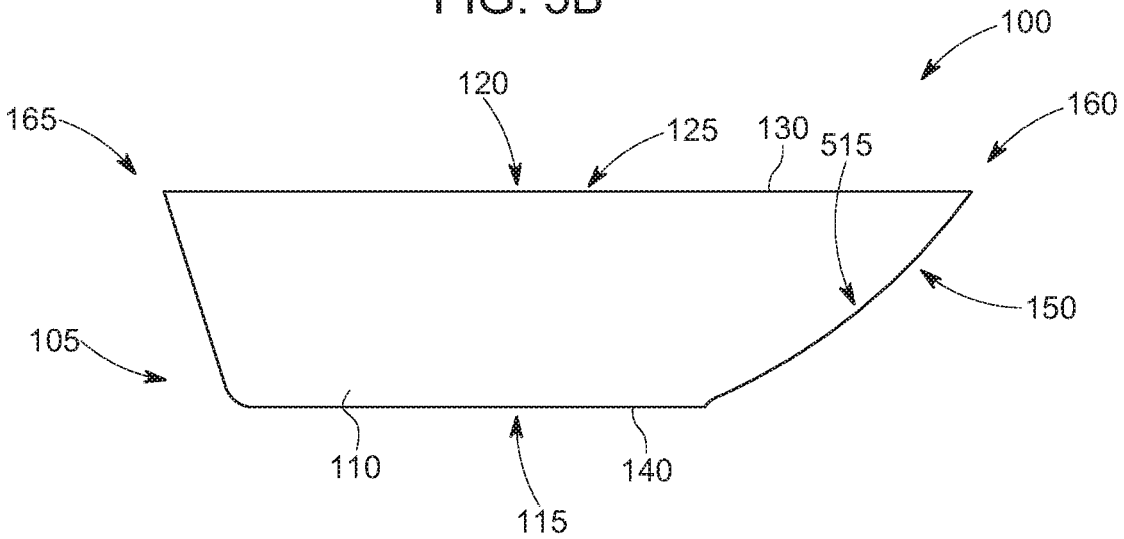
FIG. 5C is a schematic side view of another version of a condiment container according to the invention.
Figure 6A:
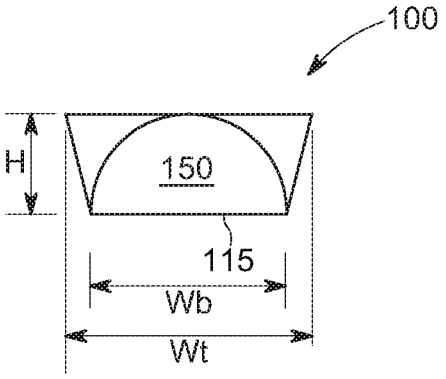
FIG. 6A is a schematic rear view of a particular condiment container according to one version of the invention.
Figure 6B:
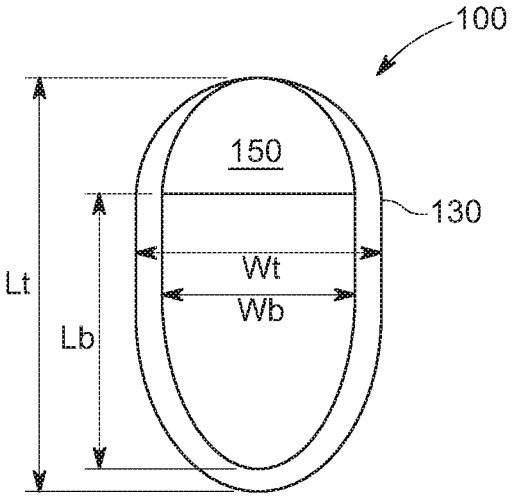
FIG. 6B is a schematic top view of the condiment container of FIG. 6A.
Figure 6C:
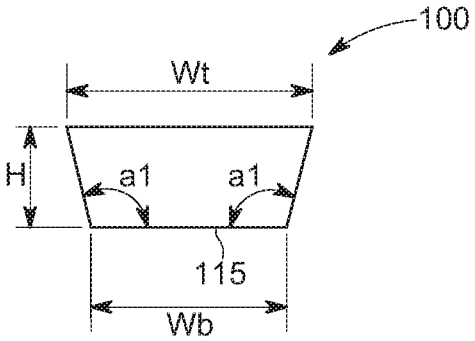
FIG. 6C is a schematic front view of the condiment container of FIG. 6A.
Figure 6D:
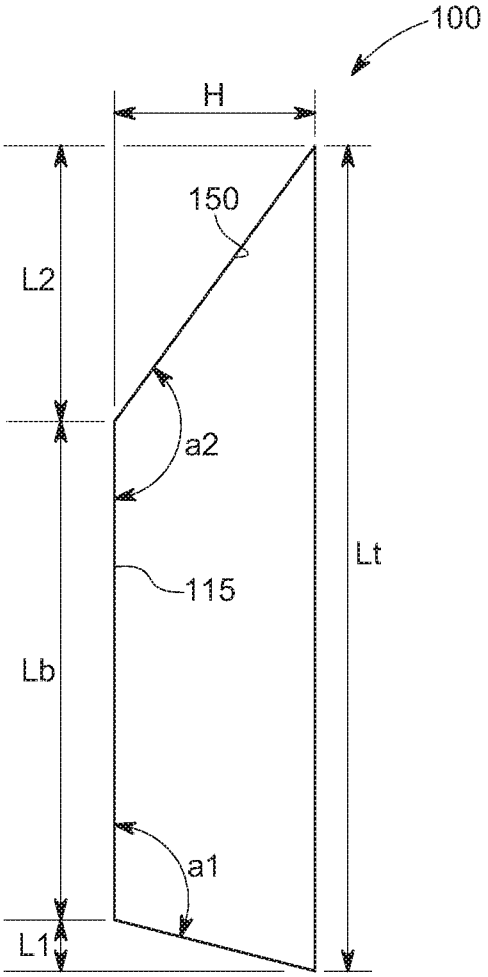
FIG. 6D is a schematic sectional view of the condiment container of FIG. 6A.

FIGS. 5A, 5B, and 5C show alternative versions of the ramp portion 150 of the condiment container 100. In the version of FIG. 5A, the interior of the condiment container 100 is the same as the version of FIGS. 1A and 1B. However, in this version, the exterior of the body 105 includes a solid section 510 that makes that extends the bottom 115 and provides a base under the ramp portion 150. The solid section 510 helps to prevent tipping of the condiment container 100 when pressure is applied to the ramp portion 150. FIGS. 5B and 5C illustrate alternative ramp portions 150 where instead of being planar, the ramp portion 150 is curved or rounded. In FIG. 5B, the ramp portion 150 has an inward curvature 510, and in FIG. 5C, the ramp portion 150 has an outward curvature 515. The curvatures can alternatively be in the form of a portion of a cylinder or parabola or the like. Alternatively, the curvature can be a bowl shape. The curvature can also be a combination of these or other curved shapes. In the versions of FIGS. 5B and 5C, the ramp portion 150 will have a slope defined by tangents to the curves. A slope on the bottom half of the ramp portion 150 will be less steep than a corresponding slope on another portion of the side wall and/or a slope on the top half of the ramp portion 150 will be less steep than a corresponding slope on another portion of the side wall.

FIGS. 6A through 6D show, respectively, a schematic rear view, top view, front view, and longitudinal sectional view of a condiment container according to one particular version of the invention. Dimensionally, the condiment container 100 can take on the sizes and shapes necessary to suit a desired situation. Though exemplary dimensions will be discussed for one version of the invention, the condiment container 100 can take on any other dimension and shape. The condiment container 100 of FIGS. 6A though 6D shows a representative condiment container suited for administering condiment to a food item, such as a chicken wing. In this version, the condiment container 100 has a height, H, from about 10 mm to about 40 mm, more preferably from about 20 mm to about 30 mm, and most preferably about 23 mm. The width, Wt, of the top of the condiment container 100 is from 30 mm to 90 mm, more preferably from 50 mm to 65 mm, and most preferably about 58 mm, the width, Wb, of the bottom of the condiment container 100 is from 25 mm to 80 mm, more preferably from 40 mm to 55 mm, and most preferably about 46 mm. The length, Lt, of the top of the condiment container 100 is from 50 mm to 150 mm, more preferably from 80 to 120 mm, and most preferably about 97 mm. The length, Lb, of the bottom of the condiment container is from about 30 mm to about 90 mm, more preferably from about 50 mm to about 65 mm, and most preferably about 58 mm. The angle, a2, of the ramp portion 150 from the bottom 115 is from about 110 degrees to about 170 degrees, more preferably from about 130 degrees to about 160 degrees, and most preferably about 144 degrees. The angle, a1, of the side wall other than the ramp portion from the bottom 115, is from about 90 degrees to about 130 degrees, more preferably from about 95 degrees to about 115 degrees, and most preferably about 105 degrees. The length, L1, of the condiment container 100 in the longitudinal direction from the forward-most end of the bottom to the forward-most end of the top is from about 0 mm to about 30 mm, more preferably from about 3 mm to about 10 mm, and most preferably about 6 mm. The length, L2, of the condiment container 100 in the longitudinal direction from the rearward-most end of the bottom to the rearward-most end of the top is from about 15 mm to about 60 mm, more preferably from about 25 mm to about 45 mm, and most preferably about 35 mm.

The condiment container 100 is shaped and dimensioned to provide a desirable reservoir volume. Thus, the condiment container 100 of the invention can use the same or less condiment than a conventional container that does not include a ramp portion and can more efficiently and effectively distribute the condiment to a food item. In one version, the volume of the reservoir 120 is from about 20 ml to about 70 ml, more preferably from about 30 ml to about 60 ml, more preferably from about 40 ml to about 50 ml, and most preferably about 44 ml to about 45 ml. Clearly, the volume can be adjusted to accommodate a particular food item. For example, a condiment container 100 designed to coat a turkey leg is going to be significantly larger than one designed for a celery stick.

The condiment container 100 can be made of any food grade material or any material that is intended to be in contact with food and has been proven to be safe. Food grade materials can be constructed from a variety of materials, such as plastic, rubber, paper, coatings, metals, glasses, and the like. In one version of the invention, the condiment container 100 is made of a plastic food grade material, such as one or more of polyethylene terephthalate, polypropylene, high-density poly ethylene, low-density polyethylene, polycarbonate, and the like. In one particular version, the condiment container 100 comprises polypropylene.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Therefore, any appended claims should not be limited to the description of the preferred versions contained herein and should include all such alterations, permutations, and equivalents as fall within the true spirit and scope of the present invention.

What is claimed is:

1. A method of applying condiment to a chicken wing, the method comprising:

providing a condiment container comprising a body having a side wall, a bottom having a planar portion, and an open top, the side wall and the bottom defining a reservoir that can contain a condiment, wherein the side wall includes a ramp portion having a slope that is less steep relative to the planar portion than a second portion of the side wall, wherein the open top is at least partially ovate and sized to receive a chicken wing, and wherein the reservoir is sized and shaped to receive a chicken wing in a manner that reduces wasted condiment;

inserting a chicken wing item into condiment in the reservoir; and dragging the chicken wing across the ramp portion to distribute the condiment in a desirable manner.

2. A method according to claim 1 wherein the ramp portion includes an at least partially flat surface.

3. A method according to claim 1 wherein the angle of the ramp portion is at least 20 degrees more than the angle of the second portion of the side wall relative to the planar portion.

4. A method according to claim 1 wherein the angle of the ramp portion is at least 30 degrees more than the angle of the second portion of the side wall relative to the planar portion.

5. A method according to claim 1 wherein the angle of the ramp portion is at least 40 degrees more than the angle of second portion of the side wall relative to the planar portion.

6. A method according to claim 1 wherein the angle of the ramp portion and the angle of the second portion of the side wall are both greater than 90 degrees relative to the planar portion.

7. A method according to claim 1 wherein the open top is defined by an upper edge of the side wall and wherein the upper edge of the side wall includes a lip capable of securing a lid.

8. A method according to claim 1 wherein the open top is entirely ovate in shape.

9. A method according to claim 1 wherein the top is planar and parallel to the planar portion.

10. A method of applying condiment to a chicken wing, the method comprising:

providing a condiment container comprising a body having a side wall, a bottom having a planar portion, and an open top, the side wall and the bottom defining a reservoir that can contain a condiment, wherein the side wall includes a ramp portion having a slope that is less steep relative to the planar portion than a second portion of the side wall, wherein the open top is at least partially oval and sized to receive a chicken wing, and wherein the reservoir is sized and shaped to receive a chicken wing in a manner that reduces wasted condiment;

inserting a chicken wing item into condiment in the reservoir; and dragging the chicken wing across the ramp portion to distribute the condiment in a desirable manner.

11. A method according to claim 10 wherein the ramp portion includes an at least partially flat surface.

12. A method according to claim 10 wherein the angle of the ramp portion is at least 20 degrees more than the angle of the second portion of the side wall relative to the planar portion.

13. A method according to claim 10 wherein the angle of the ramp portion is at least 30 degrees more than the angle of the second portion of the side wall relative to the planar portion.

14. A method according to claim 10 wherein the angle of the ramp portion is at least 40 degrees more than the angle of second portion of the side wall relative to the planar portion.

15. A method according to claim 10 wherein the angle of the ramp portion and the angle of the second portion of the side wall are both greater than 90 degrees relative to the planar portion.

16. A method according to claim 10 wherein the open top is defined by an upper edge of the side wall and wherein the upper edge of the side wall includes a lip capable of securing a lid.

17. A method according to claim 10 wherein the open top is entirely ovate in shape.

18. A method according to claim 10 wherein the top is planar and parallel to the planar portion.

* * * * *